US010258095B2

(12) United States Patent
Ahmed

(10) Patent No.: US 10,258,095 B2
(45) Date of Patent: Apr. 16, 2019

(54) COMFORTABLE GLOVE WITH MINIMAL FOURCHETTE STRUCTURE

(71) Applicant: Mohammed Ejaz Ahmed, Glenmont, NY (US)

(72) Inventor: Mohammed Ejaz Ahmed, Glenmont, NY (US)

( * ) Notice: Subject to any disclaimer, the term of this patent is extended or adjusted under 35 U.S.C. 154(b) by 136 days.

(21) Appl. No.: 15/622,414

(22) Filed: Jun. 14, 2017

(65) Prior Publication Data

US 2018/0360144 A1 Dec. 20, 2018

(51) Int. Cl.
*A41D 19/02* (2006.01)

(52) U.S. Cl.
CPC ..... *A41D 19/02* (2013.01)

(58) Field of Classification Search
CPC ..... A41D 19/02
USPC ..... 2/163, 161, 160
See application file for complete search history.

(56) References Cited

U.S. PATENT DOCUMENTS 1,542,199 A * 6/1925 White ..... A41D 19/02 2/161.6
1,620,643 A * 3/1927 Gillian ..... A41D 19/02 2/161.6
1,666,023 A * 4/1928 Sturm ..... A41D 19/02 2/169
2,538,837 A * 1/1951 Johnston ..... A41D 19/02 2/169
2,728,082 A * 12/1955 Slimovitz ..... A41D 19/015 2/167
4,590,626 A 5/1986 Chen
4,987,614 A 1/1991 Murray
5,167,038 A * 12/1992 Rinehart ..... A41D 19/0006 2/163
5,504,942 A * 4/1996 Kuwahara ..... A41D 19/00 2/161.6
5,603,119 A * 2/1997 Rinehart ..... A41D 19/00 2/161.1
5,924,137 A 7/1999 Gold
6,029,276 A * 2/2000 White ..... A41D 19/01529 2/161.1
6,732,378 B2 5/2004 Novak
7,114,192 B1 * 10/2006 Prouty ..... A41D 19/015 2/161.6
7,536,730 B2 5/2009 Estrella
9,642,406 B2 * 5/2017 Kusjanovic ..... A41D 19/01547
2003/0106133 A1 6/2003 Novak
2007/0006362 A1 1/2007 Estrella
2008/0244808 A1 10/2008 Chaen
2009/0199319 A1 * 8/2009 Jenkin ..... A41D 19/001 2/158
2010/0037362 A1 * 2/2010 Green ..... A41D 19/015 2/161.1

* cited by examiner

*Primary Examiner* — Gloria M Hale
(74) *Attorney, Agent, or Firm* — Lawrence D. Cutter, Esq.

(57) ABSTRACT

The fourchette structure in a glove is reduced to a minimal level resulting in a glove structure having fewer seams, shorter seams and is more readily manufacturable using conventional materials. The resulting glove is more comfortable and is less prone to failure along its seams.

4 Claims, 8 Drawing Sheets

COMFORTABLE GLOVE WITH MINIMAL FOURCHETTE STRUCTURE

TECHNICAL FIELD

The present invention is generally directed to gloves and their manufacture. More particularly, the present invention is directed to the manufacture of gloves without the presence of the usual fourchette panels which extend upward along the fingers of the glove. Even more particularly, the present invention is directed to the structure and manufacturing of a glove with a reduced number of seams and which exhibits improved levels of comfort for the wearer.

BACKGROUND OF THE INVENTION

It is best to discuss the nature and background of the present invention by specifically describing for the reader exactly what a fourchette is. A fourchette is a portion of a glove. According to Wiktionary, a "fork-shaped instrument or device, specifically the forked structure between two fingers of a glove." Wikipedia refers to a fourchette as "the inside panels on the fingers of some glove styles." The Shorter Oxford English Dictionary (Sixth Edition; 2007) defines fourchette as a "forked object, instrument, or device; specifically the forked piece between two adjacent fingers of a glove." It is also useful to point out that a completed glove typically includes a palm portion (side), finger extensions and a backside opposite to the palm portion (side).

However, the presence of fourchette structures in gloves poses several problems and disadvantages. In particular, the addition of fourchettes in a glove structure requires extra stitching thus making their manufacture more difficult, more costly and more time-consuming. Additionally, the presence of fourchettes in a glove structure provides an additional point of strain and produces an additional point of failure for the glove. In general, in any stitched fabric, the more seams there are, the greater is the opportunity to introduce a point of failure. Additionally, for some users, the inclusion of a fourchette produces a point of irritation.

From the above, it is therefore seen that there exists a need in the art to overcome the deficiencies and limitations described herein and above.

SUMMARY OF THE INVENTION

The shortcomings of the prior art are overcome and additional advantages are provided through the manufacture of a glove which has a plurality of fingers. The glove comprises: a palm portion, a thumb portion, a plurality of fourchettes attached to the palm portion, a back portion having integral finger extensions and a plurality of individual finger extensions. The glove also includes stitching which joins together the back portion and the palm portion and which also joins together the integral finger extensions and the individual finger extensions. This results in a glove construction in which the finger portions did not include fourchettes seams.

In another aspect, the present invention comprises a glove in which conventional fourchettes which extend upwards along the fingers are replaced by significantly reduced fourchette structures which are affixed to the palm portion of the glove. The glove of the present invention comprises five different kinds of structures which are readily provided by stamping operations. These five kinds of structures are: a palm portion; a back portion having integral finger extensions; a separate set of individual finger extensions; a thumb portion a fixable to an opening in the palm portion; and a plurality of small fourchette or fourchette like structures affixed to the palm portion between the fingers.

In another embodiment of the present invention, the small fourchettes described above are omitted. This provides a means for ventilation, especially for any perspiration that may be present between the glove and the user's hand.

Accordingly, it is an object of the present invention to provide a structure for a glove which is easily manufactured.

It is another object of the present invention to reduce the number of seams required in the manufacture of a glove.

It is yet another object of the present invention to reduce any irritation to a user that is introduced because of the presence of long fourchette structures along the fingers.

It is a still further object of the present invention to produce a glove which has fewer seams and therefore fewer potential points for failure.

It is still another object of the present invention to produce a glove which is easy to manufacture using a number of different materials including leather, suede, cotton, multiple fabrics and various elastomeric materials.

It is also an object of the present invention to provide a glove structure in which finger extensions are an integral part of the backside of the glove.

It is an additional object of the present invention to provide an easily manufacturable glove structure which also provides a means for ventilation perspiration that may develop with use.

Lastly, but not limited hereto, it is an even further object of the present invention to simplified glove manufacture.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

Figure 1:
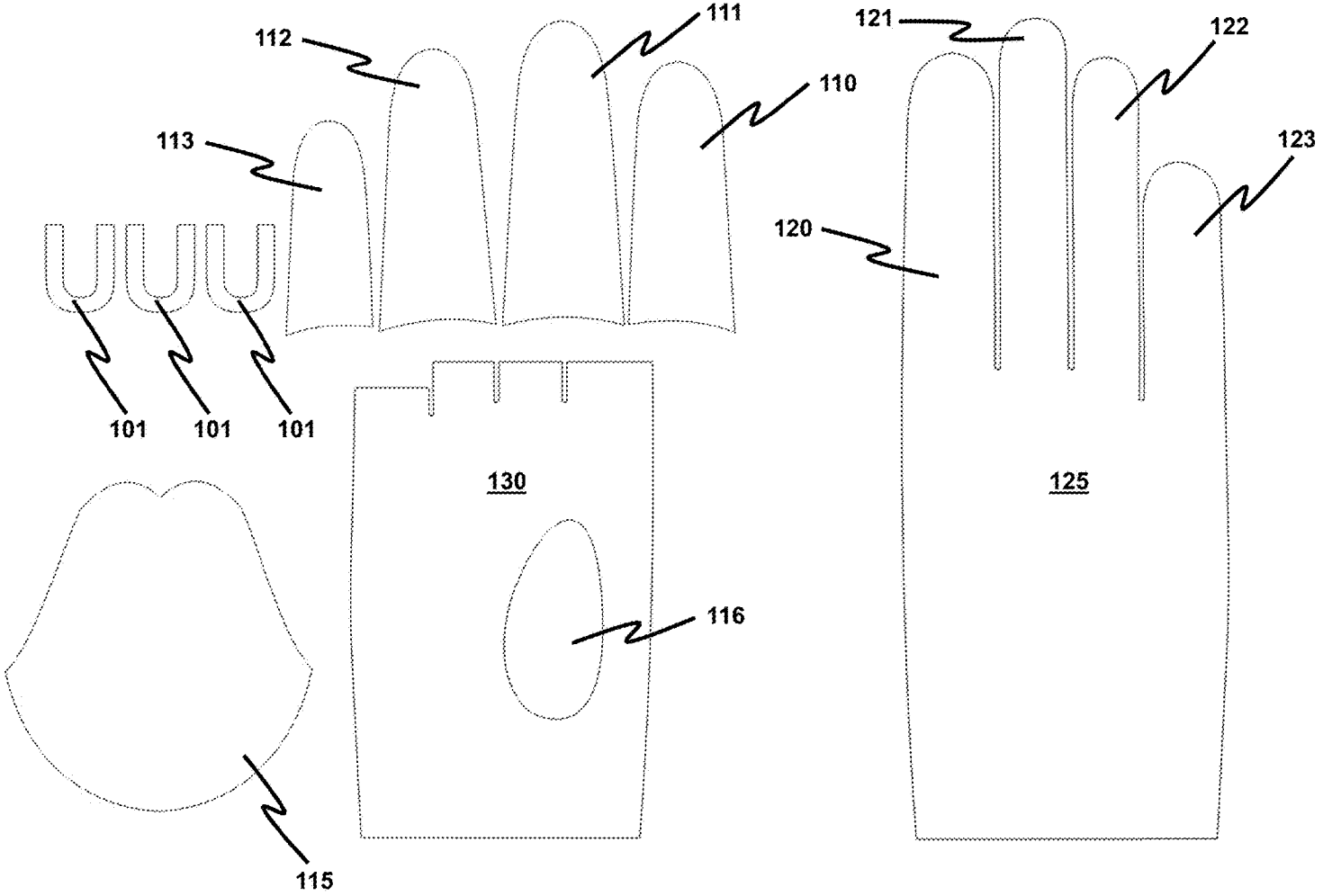
FIG. 1 is an exploded view illustrating the five different kinds of structures employed in constructing the glove of the present invention.

The drawings herein are divided into three main groupings. FIG. 1 illustrates the various parts or components that are employed in constructing the glove of the present invention. FIGS. 2 through 7 illustrate various steps employed in the construction of the present invention. It is noted that not all of the steps are performed in the order listed in the drawings. However, the order provided illustrates a preferred method of manufacture. The last, and third drawing grouping, is FIG. 8 which illustrates a glove completed in accordance with the structure and method of the present invention.

FIG. 1 illustrates the five different components (or component types) employed in the construction of the present invention. In particular, there is shown back portion 125, palm portion 130, thumb portion 115, finger extensions 110 through hundred and 13 and fourchettes 101. It is noted that the fourchettes of the present invention are not the standard fourchettes which extend up along the sides are edges of the fingers of a glove. It is also noted that, as described herein, there are two kinds of finger extensions. In particular, finger extensions 120 through 123 are integral with back portion 125 of the glove. Reference numeral 120 refers to the index finger, reference numeral 121 refers to the middle finger, reference numeral 122 refers to the ring finger and reference numeral 123 refers to the pinky finger. In contrast to finger extensions 120 through 123, finger extensions 110 through 113 are described as individual finger extensions. These include individual index finger extension 110, individual middle finger extension 111, individual ring finger extension 112 and individual pinky finger extension 113. Accordingly, it is seen that it is important to distinguish integral finger extensions 120 through 123 which are formed in an integral fashion with glove back 125. In contrast, individual finger extensions are produced in a separate fashion as is more particularly illustrated in FIG. 2.

It is noted that the components employed in the present invention for glove manufacture also include palm portion 130 having opening 116 to which thumb portion 115 is ultimately attached. The components of the present invention also include fourchette structures 101, as illustrated. In contrast to conventional fourchette structures which are attached to and/or form a part of the individual fingers, fourchettes 101 of the present invention are attached to palm portion 130.

Figure 2:
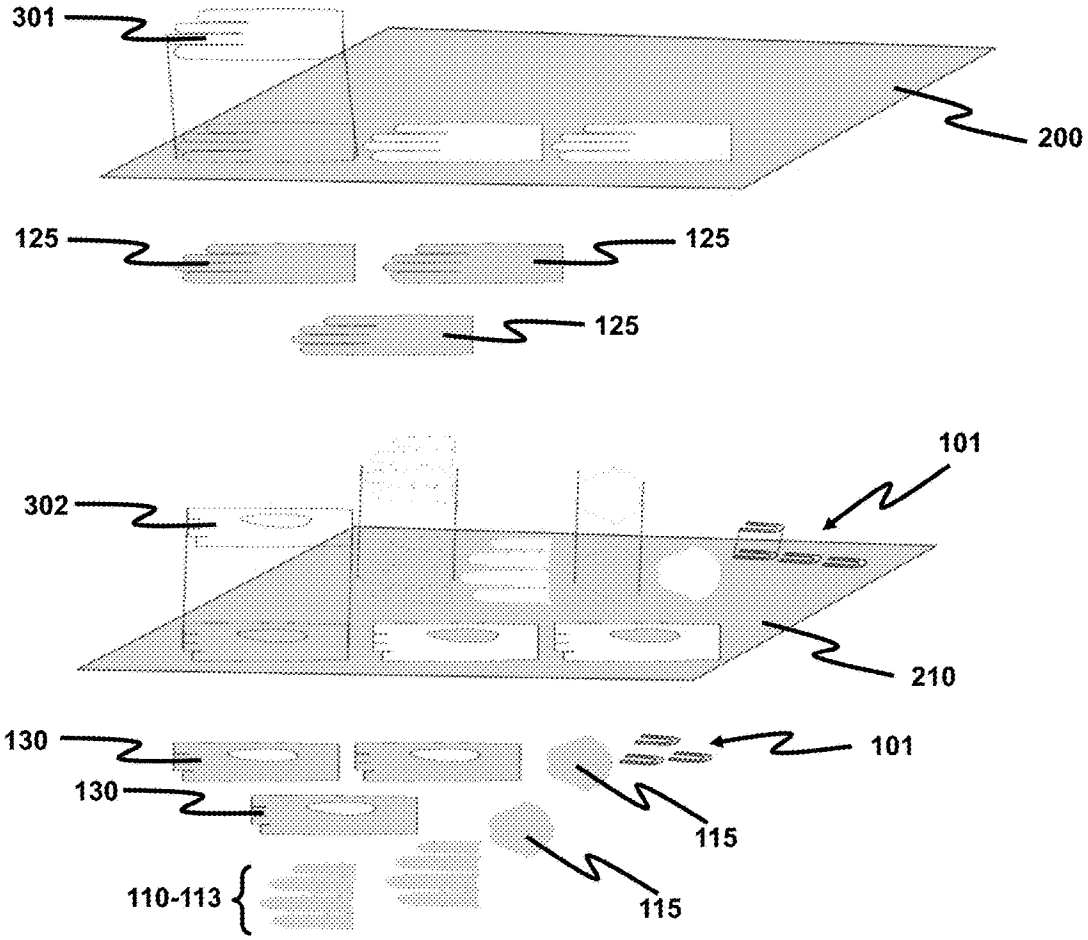
FIG. 2 it is also an exploded view illustrating how the various glove components in FIG. 1 are produced in one or more stamping operations.

One of the advantages of the glove herein is the fact that it's compounded pieces are readily machine produced by stamping and/or cutting operations. In particular, FIG. 2 illustrates these operations. In particular, it is seen that stamp 301 is employed in conjunction with material 200 resulting in the production of glove back 125 with its integral finger extensions 120 through 123. Likewise, stamp 302 is used in conjunction with material 210 to produce a glove backs 130. Glove backs 130 do not include finger extensions per se. As seen, however, they include stub structures to which the finger extensions are ultimately attached. It is noted that the stamping operations shown in FIG. 2 also produces fourchettes 101 and thumb portions 115. Likewise it is noted that a stamping operation is readily employable to produce finger extensions 110 through 113.

It is noted that the structure of the glove herein renders it possible to employ different materials for each of the five different components or component types shown herein. In particular, it is not necessary that glove back 125 comprise the same material as the palm of the glove 130. Additionally, it is noted that fourchettes 101 may be fabricated from a different sheet of material other than sheet 210 (or 200) as shown in FIG. 2.

Figure 3A:
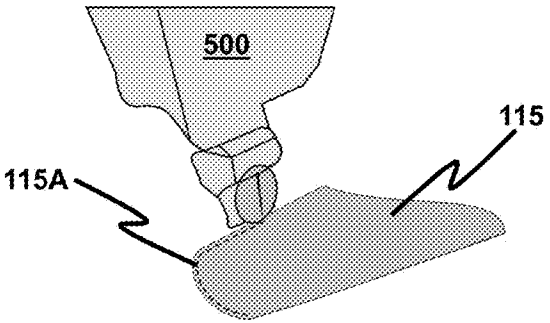
FIG. 3A illustrates stitching the thumb of the glove.
Figure 3B:
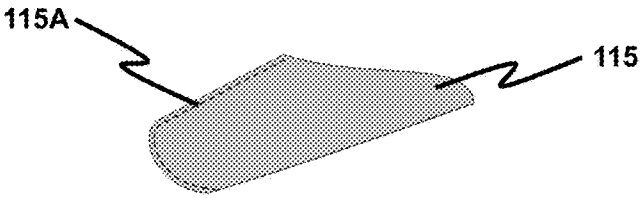
FIG. 3B illustrates the thumb after stitching.
Figure 3C:
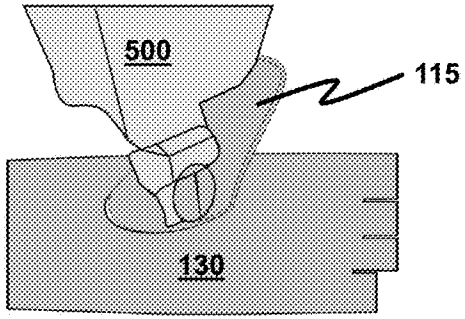
FIG. 3C illustrates attachment of the thumb to the palm portion of the glove.
Figure 3D:
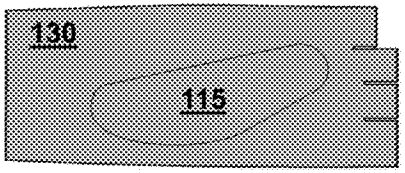
FIG. 3D illustrates the palm portion of the glove after attachment of the thumb.

FIGS. 3A through 3D illustrate the steps employed in attaching thumb portion 115 to palm portion 130. In particular, selling device 500 is employed through provide stitching 115A which is used to form thumb portion 115. In particular, the thumb structures shown in FIG. 1 is folded over and stitched produce a structure into which a thumb may be inserted. After the structures shown in FIG. 3B is produced, it is sewn on to palm portion 130 along the edges of thumb opening 116. This operation is shown in FIG. 3C. The resultant structure is shown in FIG. 3D which illustrates an assembled palm portion 130 and thumb portion 115.

Figure 4B:
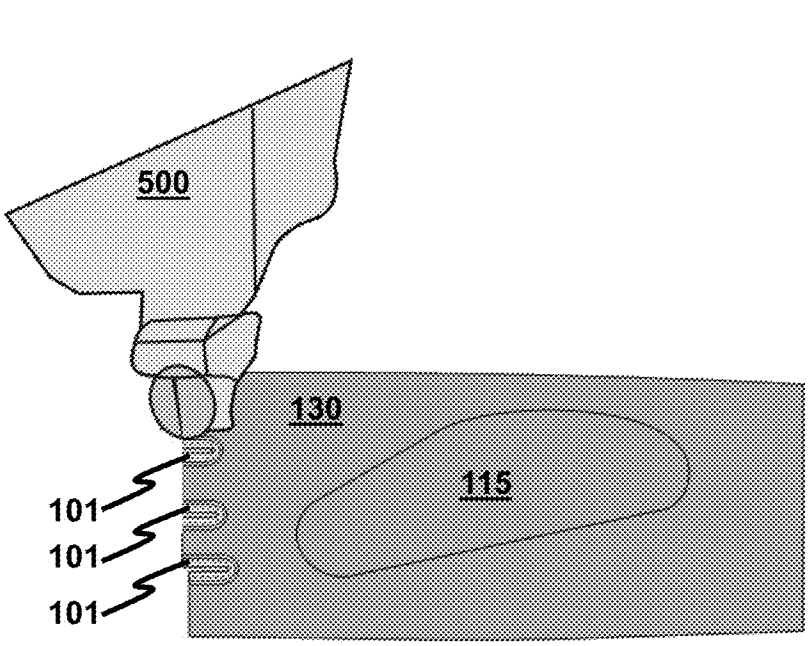
FIG. 4B illustrates the attachment of the fourchette structures to the palm portion along the other edge of the fourchette
Figure 4A:
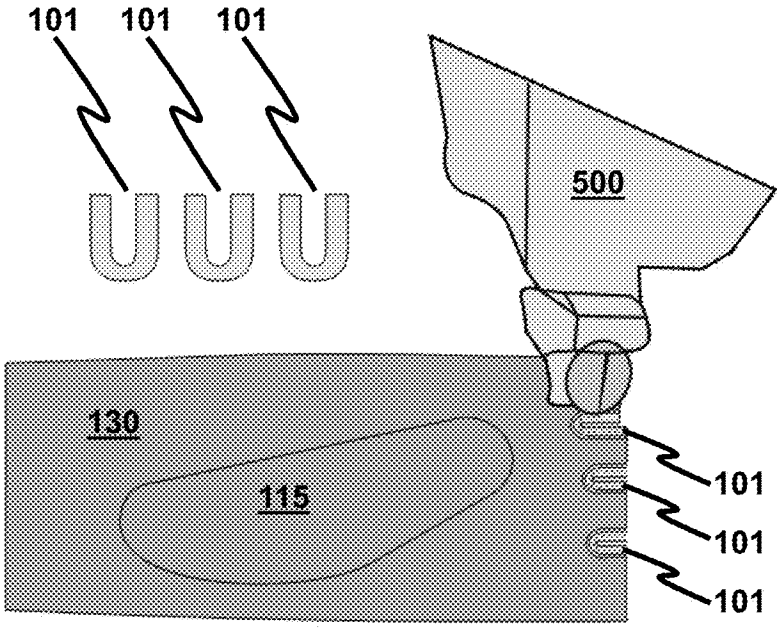
FIG. 4A illustrates the attachment of the fourchette structures to the palm portion along one edge of the fourchette.

FIGS. 4A and 4B illustrate the next step in the manufacture of the glove of the present invention. In particular, this figure illustrates the stitching of fourchettes 101 between the finger extensions stubs at the end of palm portion 130. In particular, it is noted that in the present invention these fourchette structures are limited in their extent to their presence in the palm portion of the glove. They do not extend up the finger portions, as in conventional gloves. In particular, it is noted that fourchettes 101 are attached to palm portion 130.

Figures 5A, 5B, 5C, 5D:
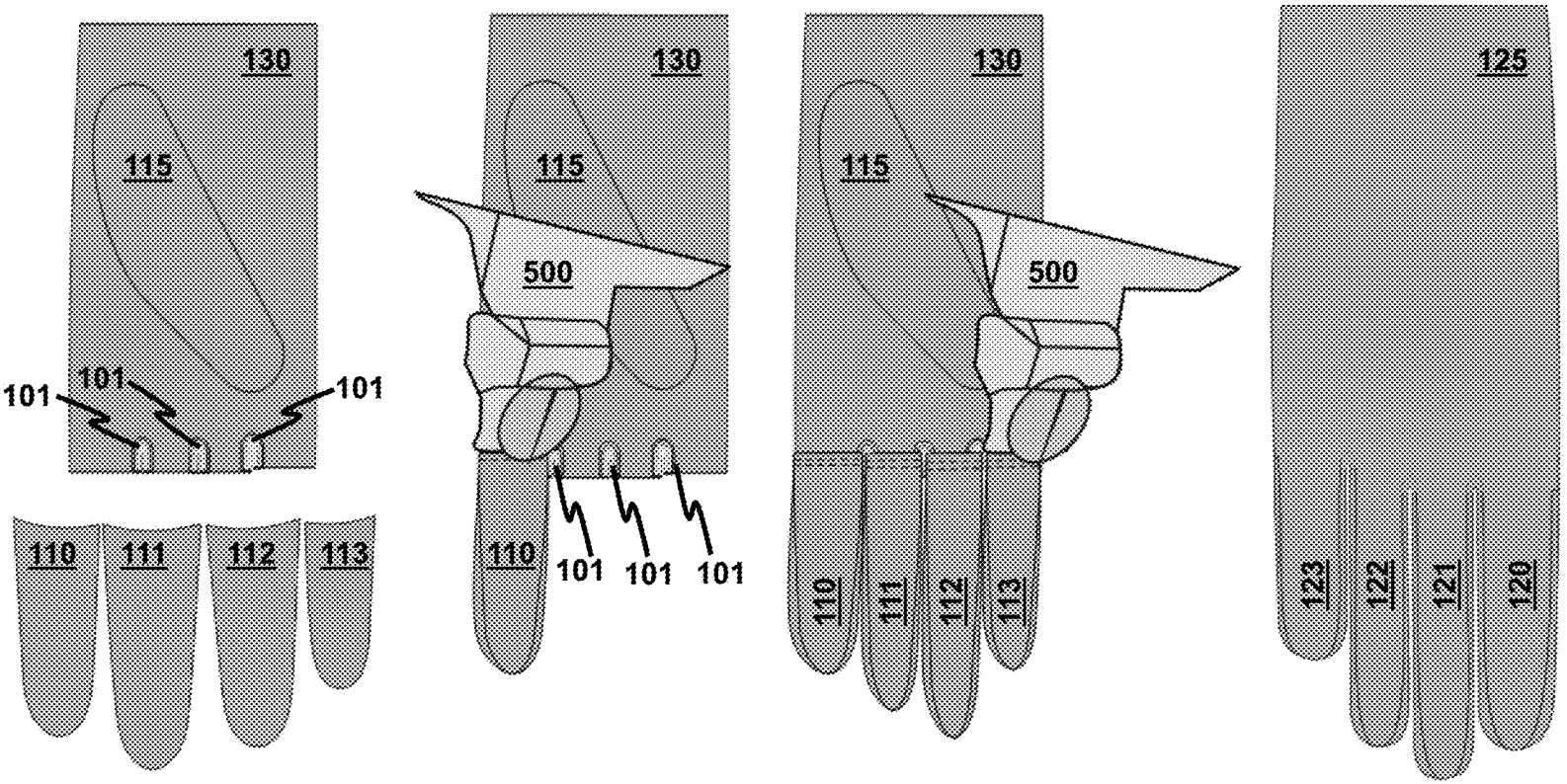
FIG. 5A illustrates placement of the finger portions relative to the palm portion prior to finger attachment.
FIG. 5B illustrates the glove in process after attachment of a first finger portion to the palm portion.
FIG. 5C illustrates the glove in process after attachment of the last finger portion to the palm portion.
FIG. 5D illustrates the palm portion of the glove after attachment of all of the finger portions.

FIG. 5 illustrates another step in the manufacture of the present invention in which individual finger extensions 110 through 113 are attached to palm portion 130. FIG. 5A through FIG. 5C illustrate progressive steps in the process as individual ones of the individual finger extensions are attached to palm portion 130. FIG. 5D illustrates the resultant structure as seen from the backside 125 of the glove.

Figure 6B:
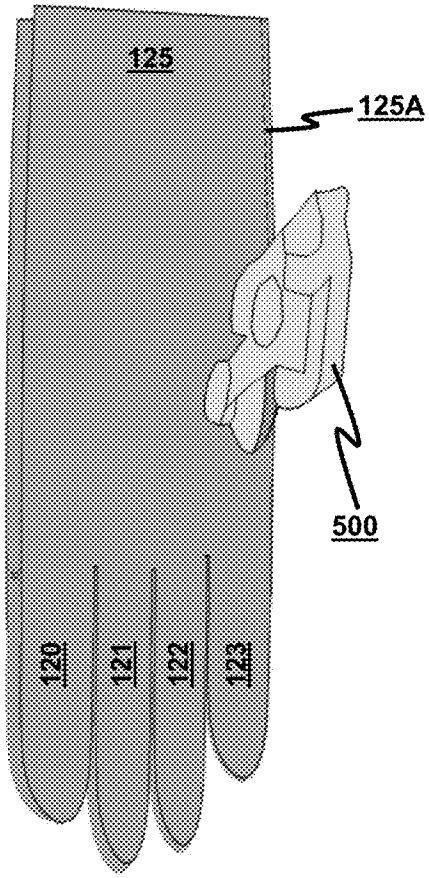
FIG. 6B illustrates stitching together of the palm portion and the back portion of the glove.
Figure 6A:
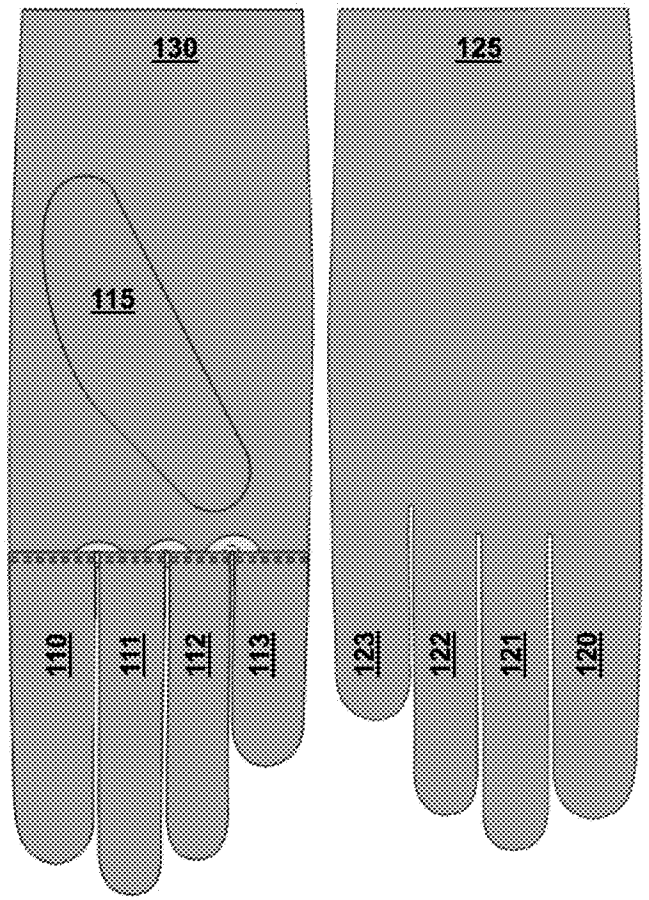
FIG. 6A illustrates positioning of the palm portion, with finger portions attached, and the back portion prior to stitching them together.

FIGS. 6A and 6B illustrate the next step in the process in which palm portion 130 is mated with back portion 125 and the resultant structure is stitched along the outside edges as illustrated by stitching 125A.

Figures 7A, 7B, 7C, 7D:
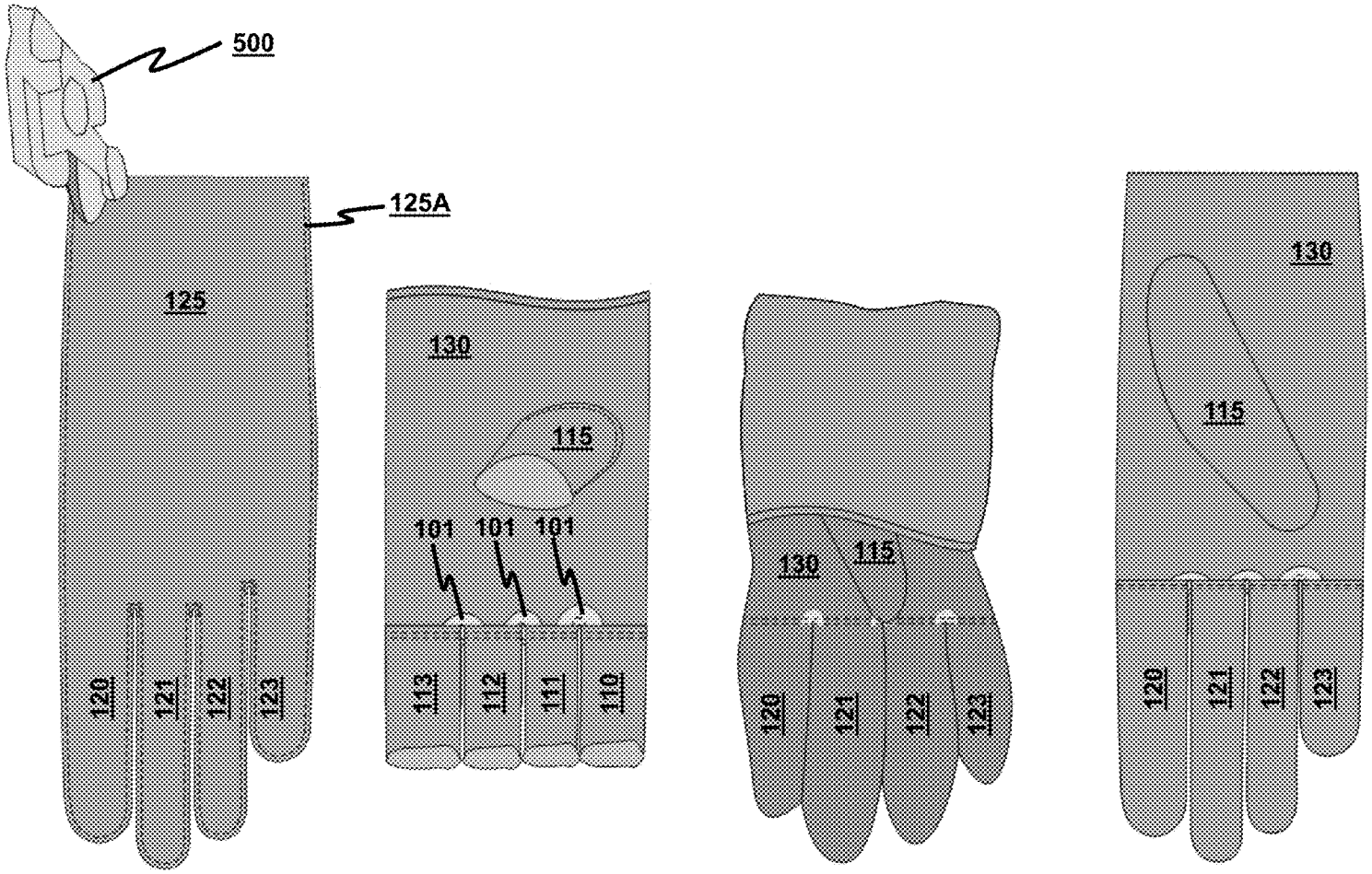
FIG. 7A illustrates the end stage of the stitching operation.
FIG. 7B illustrates the structure that results after the step shown in FIG. 7A, from the palm side.
FIG. 7C illustrates a final step in the manufacturing operation in which the glove is inverted.
FIG. 7D illustrates the final structure from the palm side.
Figure 8:
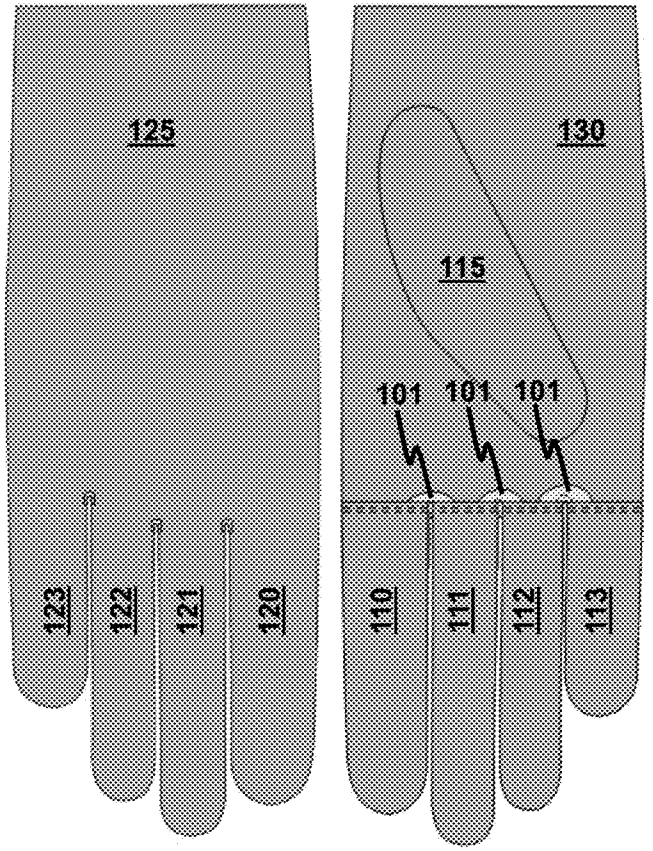
FIG. 8 illustrates a completed glove in accordance with the present invention.

FIG. 7A illustrates the end stage of the stitching operation. FIG. 7B illustrates the structure that results after the step shown in FIG. 7A but from the palm side. FIG. 7C illustrates a final step in the manufacturing operation in which the glove is inverted. The resulting structure is also illustrated in FIG. 7D, but from the palm side. Lastly, a completed glove structure is illustrated in FIG. 8.

In an alternate embodiment of the present invention, the small fourchettes 101 shown in the figures herein are omitted from the final structure. This provides ventilation openings at the base of the fingers, that is in the area of the webbing between the user's fingers. This is readily accomplished by eliminating the step shown in FIGS. 4A and 4B. The resulting structure is that shown in FIGS. 5B, 7B and 8 where fourchettes 101 are not present. The method of providing such a ventilation opening is provided by limiting the stitching so that it extends a limited distance along the integral finger extensions. The number of ventilation openings is determined by the number of small fourchette inserts used. It is not necessary to omit all of the small fourchettes or to include all of the fourchettes. Any convenient number may be employed.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 USC § 112, sixth paragraph, unless the element is expressly recited using the phrase "means for."

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

What is claimed is:

1. A glove having a plurality of fingers, said glove comprising:

a palm portion having attachment edges for attachment of individual finger extensions to said palm portion, said palm portion also having a thumb opening;

a thumb portion affixed to said thumb opening at said thumb opening;

a plurality of fourchettes attached to said palm portion and disposed between said edges for attachment of said individual finger extensions;

a plurality of said individual finger extensions affixed to said palm portion at said attachment edges;

a back portion having integral finger extensions; and stitching which joins together said back portion and said palm portion and which also joins together said integral finger extensions and said individual finger extensions so as to form said fingers, whereby said finger extensions have no fourchette seams and whereby said fingers comprise a first portion integral with said back portion and a second portion comprising said individual finger extensions.

2. The glove of claim 1 in which said stitching, which joins said back portion and said palm portion, also joins together said integral and said individual finger extensions.

3. The glove of claim 1 in which said thumb portion, said palm portion, said back portion and said finger extensions individually comprise material selected from a group consisting of leather, fabric, cotton, elastomeric materials, wool, and suede.

4. A glove having a plurality of fingers, said glove comprising:

a palm portion having attachment edges for attachment of individual finger extensions to said palm portion, said palm portion also having a thumb opening;

a thumb portion affixed to said thumb opening at said thumb opening;

a plurality of said individual finger extensions affixed to said palm portion at said attachment edges;

a back portion having integral finger extensions; and stitching which joins together said back portion and said palm portion and which also joins together said integral finger extensions and said individual finger extensions so as to form said fingers, said stitching extending a limited distance along said integral finger extensions, whereby at least one ventilation opening is provided and whereby said fingers comprise a first portion integral with said back portion and a second portion comprising said individual finger extensions.

* * * * *